US009764582B2

(12) United States Patent
Taguchi

(10) Patent No.: US 9,764,582 B2
(45) Date of Patent: Sep. 19, 2017

(54) SHEET PROCESSING APPARATUS THAT BINDS SHEETS WITH AN ADHESIVE

(71) Applicants: KABUSHIKI KAISHA TOSHIBA, Tokyo (JP); TOSHIBA TEC KABUSHIKI KAISHA, Tokyo (JP)

(72) Inventor: Hiroyuki Taguchi, Tagata Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 153 days.

(21) Appl. No.: 14/634,230

(22) Filed: Feb. 27, 2015

(65) Prior Publication Data

US 2015/0251475 A1 Sep. 10, 2015

(30) Foreign Application Priority Data

Mar. 6, 2014 (JP) ..... P2014-044365

(51) Int. Cl.
*B42C 9/00* (2006.01)
*B65H 43/06* (2006.01)
(Continued)

(52) U.S. Cl.
CPC ..... *B42C 9/0081* (2013.01); *B42C 13/00* (2013.01); *B65H 37/04* (2013.01); *B65H 43/00* (2013.01);
(Continued)

(58) Field of Classification Search
CPC ..... B42C 9/0081; B42C 13/00; B65H 37/02; B65H 37/04; B65H 39/00; B65H 43/00;
(Continued)

(56) References Cited

U.S. PATENT DOCUMENTS 6,616,135 B1 * 9/2003 Shida ..... B42C 9/0006 156/364
6,717,286 B2 * 4/2004 Tsuchiya ..... B42C 1/12 270/52.18
(Continued)

FOREIGN PATENT DOCUMENTS

JP 2009202485 A 9/2009
JP EP 2465694 A1 * 6/2012 ..... B42C 1/12

OTHER PUBLICATIONS

US Application filed Aug. 21, 2014 for U.S. Appl. No. 14/464,767.
(Continued)

*Primary Examiner* — Leslie A Nicholson, III
(74) *Attorney, Agent, or Firm* — Patterson & Sheridan, LLP

(57) ABSTRACT

A sheet processing apparatus includes a sheet holding unit, a sheet conveying unit configured to convey a plurality of sheets one by one onto the sheet holding unit during sheet processing, wherein the plurality of sheets includes a first sheet and a second sheet that is conveyed immediately after the first sheet, an adhesive applying unit configured to apply an adhesive material on the first sheet held on the sheet holding unit before the second sheet is conveyed onto the first sheet, and a pressing unit configured to press the second sheet against the first sheet after the second sheet is conveyed onto the first sheet.

18 Claims, 19 Drawing Sheets

| | | PRESSURIZING PARAMETERS FOR SECOND SHEET | | PRESSURIZING PARAMETERS FOR THIRD SHEET | | | PRESSURIZING PARAMETERS FOR LAST SHEET | |
|---|---|---|---|---|---|---|---|---|
| SHEET QUANTITY | SHEET TYPE | F1 [N] | T1 [sec] | F2 [N] | T2 [sec] | .... | Fn [N] | Tn [sec] |
| 2 TO 49 SHEETS | NORMAL PAPER | 0.05 | 1.0 | 0.05 | 1.0 | .... | 0.1 (=F1 × 2) | 5 (=T1 × 5) |
| | THICK PAPER | 0.08 | 1.5 | 0.08 | 1.5 | .... | 0.24 (=F1 × 3) | 15 (=T1 × 10) |
| EQUAL TO OR MORE THAN 50 SHEETS | NORMAL PAPER | 0.07 | 1.2 | 0.07 | 1.2 | .... | 0.28 (=F1 × 4) | 8.4 (=T1 × 7) |
| | THICK PAPER | 0.10 | 1.8 | 0.10 | 1.8 | .... | 0.60 (=F1 × 6) | 21.6 (=T1 × 12) |

(51) Int. Cl.

| | |
|---|---|
| ***B65H 43/00*** | (2006.01) |
| ***B42C 13/00*** | (2006.01) |
| ***B65H 37/04*** | (2006.01) |
| ***B65H 45/18*** | (2006.01) |
| ***B65H 45/30*** | (2006.01) |

(52) U.S. Cl.
CPC ..... *B65H 43/06* (2013.01); *B65H 45/18* (2013.01); *B65H 45/30* (2013.01); *B65H 2301/4212* (2013.01); *B65H 2301/4213* (2013.01); *B65H 2301/5113* (2013.01); *B65H 2801/27* (2013.01); *B65H 2801/48* (2013.01)

(58) Field of Classification Search
CPC ..... B65H 43/06; B65H 2301/5113; B65H 2801/27; B65H 2801/48
USPC ..... 270/58.07, 58.08, 58.09
See application file for complete search history.

(56) References Cited

U.S. PATENT DOCUMENTS

| | | | | |
|---|---|---|---|---|
| 6,978,990 | B2 * | 12/2005 | Silverbrook | B41J 3/44 270/58.07 |
| 7,713,015 | B2 * | 5/2010 | Magata | G03B 27/32 412/1 |
| 8,011,869 | B2 * | 9/2011 | Trovinger | B42C 9/00 412/19 |
| 2014/0227064 | A1 * | 8/2014 | Matsue | B42C 1/12 412/37 |

OTHER PUBLICATIONS

US Application filed Feb. 11, 2015 for U.S. Appl. No. 14/619,366.

* cited by examiner

TRANSITION OF DRIVING STATE OF PRESSURIZING MECHANISM D

| SHEET QUANTITY | SHEET TYPE | PRESSURIZING PARAMETERS FOR SECOND SHEET | | PRESSURIZING PARAMETERS FOR THIRD SHEET | | | PRESSURIZING PARAMETERS FOR LAST SHEET | |
|---|---|---|---|---|---|---|---|---|
| | | F1 [N] | T1 [sec] | F2 [N] | T2 [sec] | ···· | Fn [N] | Tn [sec] |
| 2 TO 49 SHEETS | NORMAL PAPER | 0.05 | 1.0 | 0.05 | 1.0 | ···· | 0.1 (=F1×2) | 5 (=T1×5) |
| | THICK PAPER | 0.08 | 1.5 | 0.08 | 1.5 | ···· | 0.24 (=F1×3) | 15 (=T1×10) |
| EQUAL TO OR MORE THAN 50 SHEETS | NORMAL PAPER | 0.07 | 1.2 | 0.07 | 1.2 | ···· | 0.28 (=F1×4) | 8.4 (=T1×7) |
| | THICK PAPER | 0.10 | 1.8 | 0.10 | 1.8 | ···· | 0.60 (=F1×6) | 21.6 (=T1×12) |

PROCESSING WHEN THERE IS NO SHEET COMING THEREAFTER

SHEET PROCESSING APPARATUS THAT BINDS SHEETS WITH AN ADHESIVE

CROSS-REFERENCE TO RELATED APPLICATION

This application is based upon and claims the benefit of priority from Japanese Patent Application No. 2014-044365, filed Mar. 6, 2014, the entire contents of which are incorporated herein by reference.

FIELD

Embodiments described herein relate generally to a technology of processing a plurality of sheets, especially binding the sheets.

BACKGROUND

In the related art, a post-processing apparatus performs various types of post-processing for one or more sheets on which an image is formed by an image forming apparatus. One type of the post-processing apparatus has a function to staple a bundle of sheets. However, the bundle of stapled sheets may cause a trouble when the sheets are put into a shredder without the staples being removed. Further, when the stapled sheets are used in an image forming apparatus after staples are removed, holes made by the staples may cause jamming of sheets.

DETAILED DESCRIPTION

An exemplary embodiment described herein is directed to perform firm binding of sheets without increasing the size of a sheet processing apparatus and throughput thereof.

In general, according to one embodiment, a sheet processing apparatus includes a sheet holding unit, a sheet conveying unit configured to convey a plurality of sheets one by one onto the sheet holding unit during sheet processing, wherein the plurality of sheets includes a first sheet and a second sheet that is conveyed immediately after the first sheet, an adhesive applying unit configured to apply an adhesive material on the first sheet held on the sheet holding unit before the second sheet is conveyed onto the first sheet, and a pressing unit configured to press the second sheet against the first sheet after the second sheet is conveyed onto the first sheet.

Hereinafter, an embodiment will be described with reference to the drawings.

Overall Description of Apparatus

Figure 1:
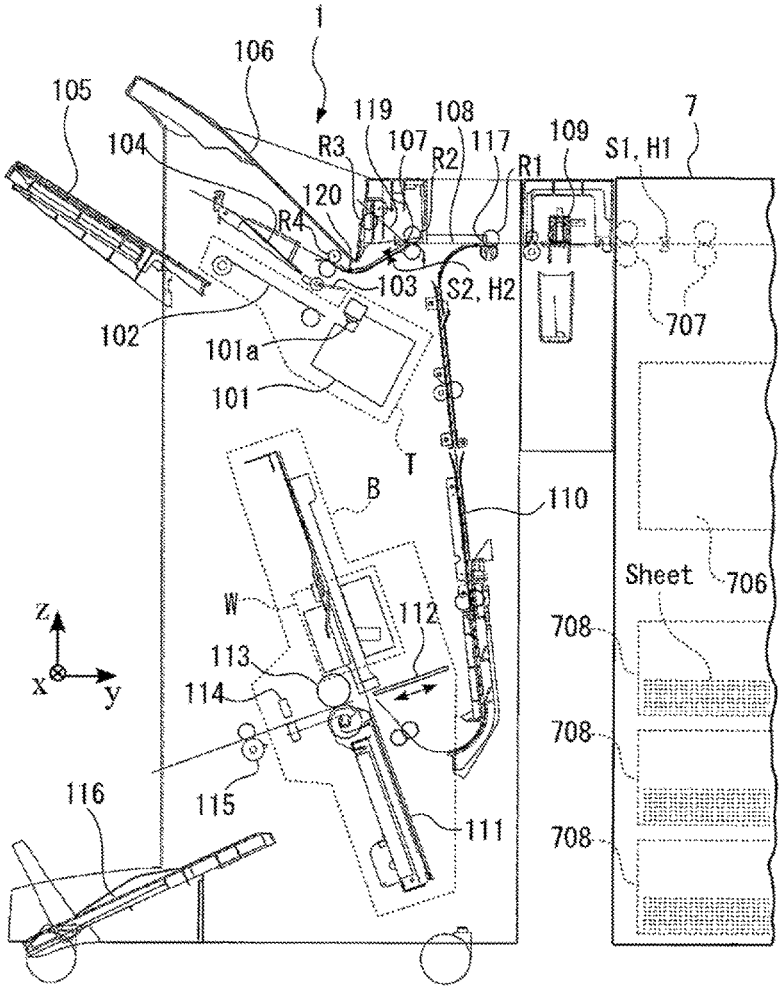
FIG. 1 is a vertical cross-sectional view of a post-processing apparatus according to an embodiment and an image forming apparatus which is connected to the post-processing apparatus.

FIG. 1 is a schematic vertical cross-sectional view of a post-processing apparatus 1 (a so-called finisher) according to the embodiment, and an image forming apparatus 7 connected to the post-processing apparatus 1.

In the image forming apparatus 7 according to the present embodiment, an image forming section 706 performs image forming on a sheet transported from a sheet supply section 708 including a so-called sheet feeding cassette, for example, by a transport roller (not illustrated). The sheet on which an image is formed by the image forming section 706 is transported toward the post-processing apparatus 1 by a transport section 707 having a transport roller and the like.

A sheet detection sensor S1 and a thickness sensor H1 are provided in the vicinity of the transport roller positioned most downstream along a route through which a sheet is transported by the transport section 707. The sheet detection sensor S1, for example, is an optical sensor of a reflection type or a transmissive type, or a mechanical sensor including a lever, the optical sensor, and the like. The sheet detection sensor S1 detects whether or not a sheet is being transported toward the post-processing apparatus 1 by the transport section 707. The thickness sensor H1, for example, is a mechanical sensor including a rotatably supported lever, the optical sensor, and the like. The thickness sensor H1 uses the optical sensor and the like to detect a rotational amount of the lever which rotates in response to a sheet passing therethrough toward the post-processing apparatus 1, and detects the thickness (whether the sheet is thick paper or normal paper) of the sheet based on the rotational amount.

The post-processing apparatus 1 according to the present embodiment, for example, receives a sheet output from the image forming apparatus 7, which is connected to the post-processing apparatus 1, so as to be able to communicate with each other. The post-processing apparatus 1 performs various types of processing such as binding, folding, and hole-punching with respect to the sheet.

For example, the post-processing apparatus 1 includes a binding section T, a folding section B, a stapler W, and a hole punching section 109 as functional units for sheet processing.

The sheet on which an image is formed in the image forming apparatus 7 first passes through the hole punching section 109. When performing the hole-punching in a sheet, the hole-punching is performed in a sheet by the hole punching section 109 at this time.

After the sheet passes through the hole punching section 109, a flapper 117 switches a destination to which the sheet is transported between a transport path 110 and a transport path 108.

If it is intended to perform only the hole-punching in the sheet or to discharge the sheet outside the apparatus after passing through the hole punching section 109, the sheet is guided to the transport path 108 by the flapper 117 and a transport roller R1. Then, the sheet is guided to a transport path 119 by a flapper 107 and a transport roller R2, thereby being discharged onto a first discharge tray 106 by a transport roller R3.

Figure 2:
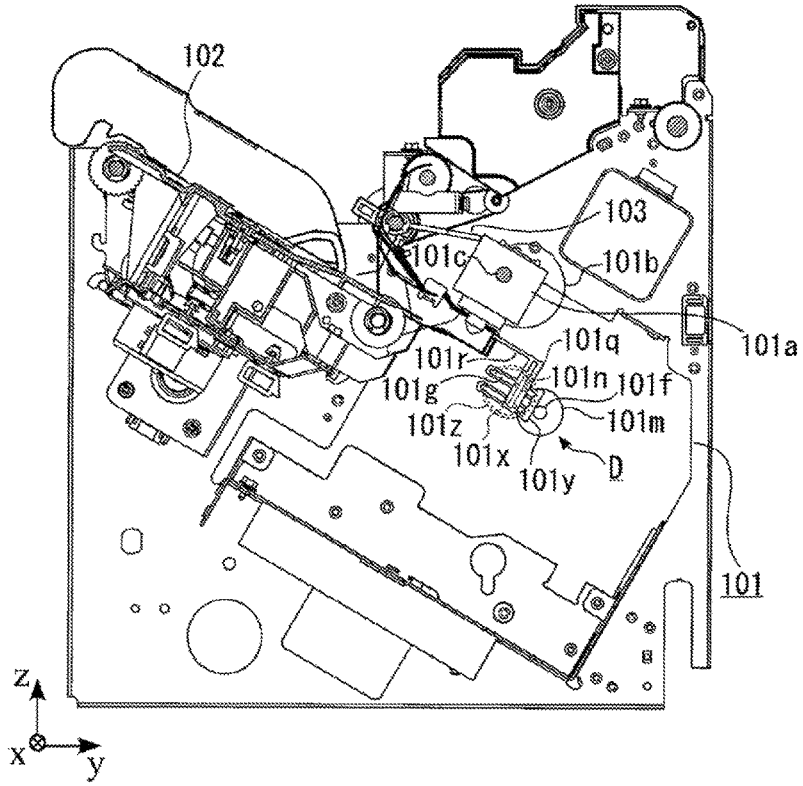
FIG. 2 is a vertical cross-sectional view of a binding section of the post-processing apparatus.

Meanwhile, if it is intended to perform binding of sheets by the binding section T, the sheet conveyed to the transport path 108 is further guided to a transport path 120 by the flapper 107 and the transport roller R2, thereby being discharged onto a buffer tray 104 by a transport roller R4. FIG. 2 is a vertical cross-sectional view of the binding section T.

After being discharged onto the buffer tray 104, the sheet is dropped on a processing tray 102 while being pushed by a paddle 103 which rotates counterclockwise in a diagram of FIG. 1, thereby being sequentially stacked on the processing tray 102. In this manner, the processing tray 102 has a role to store target sheets for binding. Therefore, in the present embodiment, for example, the transport rollers R1, R2, and R4, the flappers 117 and 107, a transport guide (not illustrated), the buffer tray 104, the paddle 103, and the like correspond to a "transport section."

Figure 3:
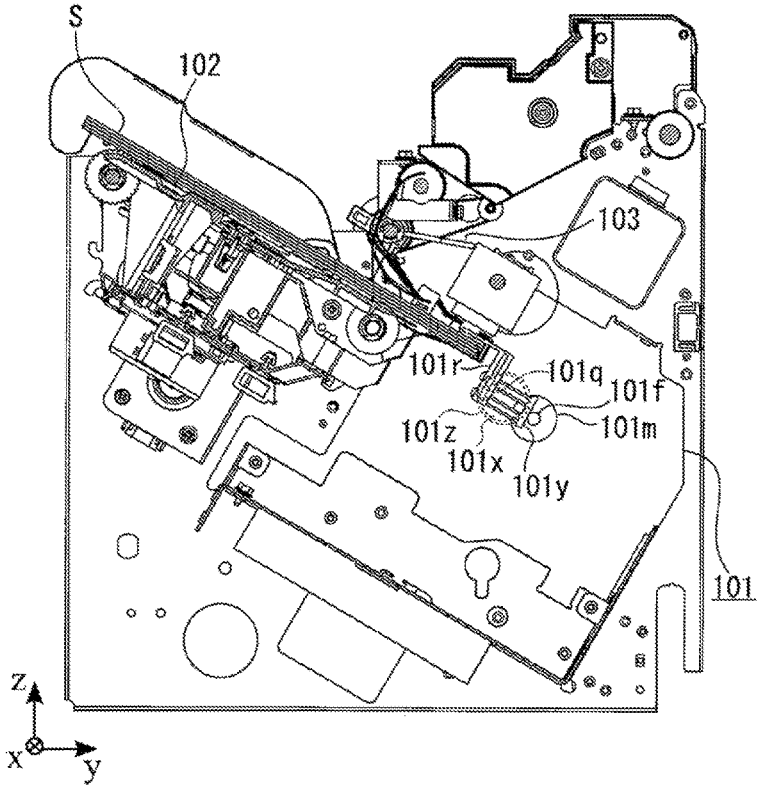
FIG. 3 is a vertical cross-sectional view of the binding section in which a bundle of sheets are stacked.

The binding section T binds a plurality of sheets by adhesion. The binding section T includes a pasting section 101 (an adhesive applying section) which performs pasting an adhesive on a top surface of the sheet stacked on the processing tray 102. In the binding section T, the pasting section 101 performs pasting the adhesive on the top surface of the sheet every time a new sheet is stacked on the processing tray 102. However, for example, if it is intended to bind a bundle of ten sheets, pasting is not performed on the top surface of the tenth sheet. FIG. 3 illustrates a state where a bundle of pasted sheets is stacked on the processing tray 102.

Figure 4:
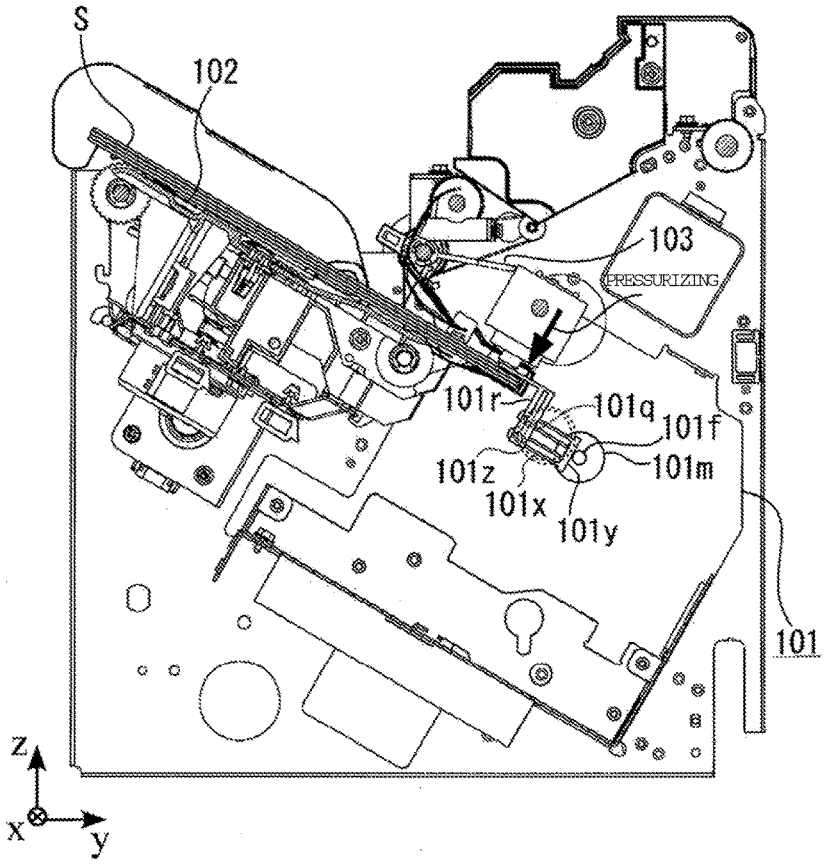
FIG. 4 illustrates a pressurization mechanism of the binding section that carries out a pressuring operation.

After all of a plurality of target sheets for binding are stacked on the processing tray 102, and pasting on the top surfaces of the sheets in a bundle of the plurality of sheets is completed except for the last sheet on the top, a pressurization mechanism D (a pressurization section) pressurizes a position corresponding to the pasting position toward the processing tray 102 in a state where the plurality of sheets overlap each other. Here, the pasting section 101 ejects as the adhesive a liquid paste on the sheets, and the plurality of sheets are pressed by the pressurization mechanism D so as to adhere firmly to each other due to the paste, thereby completing binding of the sheets (refer to FIG. 4).

Meanwhile, if it is intended to perform folding or stapling of sheets after the sheets pass through the hole punching section 109, the sheets are guided to the transport path 110 by the flapper 117. Then, stapling by the stapler W or folding by the folding section B is performed on the sheets discharged onto a stacker 111. Specifically, for example, the folding section B causes a folding blade 112 and a folding roller 113 to fold a bundle of sheets in which stapling is performed by the stapler W. The bundle of sheets is subjected to further creasing by an additionally folding roller 114. Thereafter, the bundle of folded sheets is discharged to a third discharge tray 116 by a discharge roller 115.

A sheet detection sensor S2 and a thickness sensor H2 are disposed along the transport path 120. The sheet detection sensor S2, for example, is the optical sensor of the reflection type or the transmissive type, or the mechanical sensor including the lever, the optical sensor, and the like. The sheet detection sensor S2 detects whether or not a sheet is being transported through the transport path 120. In other words, if a sheet is detected by the sheet detection sensor S2, the detection indicates that there is a sheet being supplied to the binding section T as a target for binding. The thickness sensor H2, for example, is the mechanical sensor including the rotatably supported lever, the optical sensor, and the like. The thickness sensor H2 uses the optical sensor and the like to detect a rotational amount of the lever which rotates in response to a sheet passing therethrough to be transported toward the buffer tray 104 by the transport roller R2, thereby detecting the thickness (whether the sheet is thick paper or normal paper) of the sheet.

Figure 5:
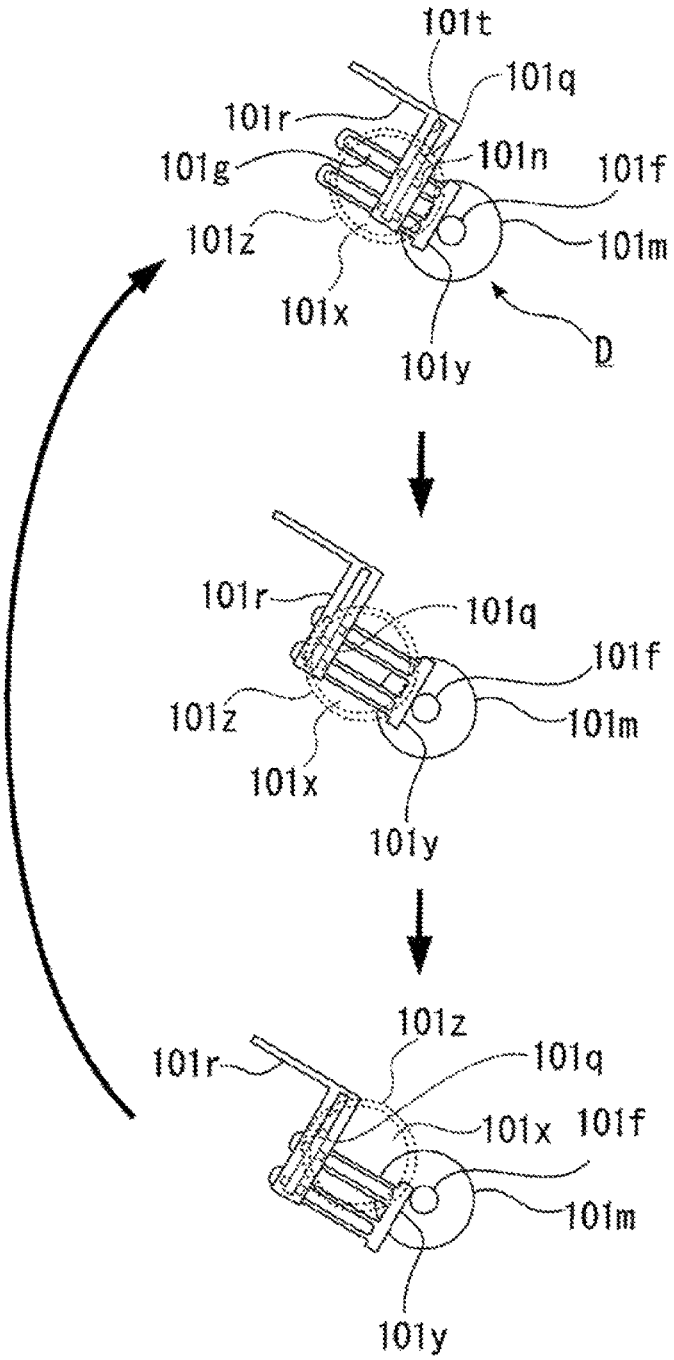
FIG. 5 illustrates a series of pressurizing operations carried out by the pressurization mechanism.

FIG. 5 illustrates a pressing operation performed by the pressurization mechanism D. The pressurization mechanism D has a role to pressurize the top surface of a second sheet stacked on a first sheet to which the pasting section 101 (the adhesive applying section) applies the adhesive, and to cause the first sheet and the second sheet to adhere to each other. As illustrated in FIG. 5, the pressurization mechanism D may include a pressing member 101*r*, a guide member 101*g*, a motor 101*z*, a cam 101*x*, a rack gear 101*y*, a motor 101*m*, a pinion gear 101*f*, a guided member 101*n*, and a pin 101*q*, for example.

Hereinafter, an operation of the pressurization mechanism D will be described.

The cam 101*x* is attached to an output shaft of the motor 101*z*, and the cam 101*x* rotates by driving the motor 101*z*. The pin 101*q* is provided in the cam 101*x*. The pin 101*q* slides inside a guide groove 101*t* formed in the pressing member 101*r*.

The guided member 101*n* is further provided in the pressing member 101*r*. The guided member 101*n* is guided along a guide groove of the guide member 101*g* so as to be able to make reciprocating motion.

Therefore, if the motor 101*z* is driven, the pin 101*q* of the cam 101*x* moves along the guide groove, and the moving pin 101*q* transfers a driving force to the pressing member 101*r* through the guide groove 101*t*. Thus, the pressing member 101*r* makes reciprocating motion along the guide groove of the guide member 101*g*.

The rack gear 101*y* which extends in a direction orthogonal to an extending direction (a pressing direction) of the guide groove of the guide member 101*g* is formed at an end portion of the pressing member 101*r*. The pinion gear 101*f* attached to an output shaft of the motor 101*m* meshes with the rack gear 101*y*. As the motor 101*m* is driven, the pressing member 101*r* may make reciprocating motion together with the guide member 101*g* in a direction in which the rack gear 101*y* extends. Therefore, it is possible to control a pressing force applied to the bundle of sheets stacked on the processing tray 102 by controlling rotations of the motor 101*m*. Here, a rack and pinion mechanism controls reciprocating operations of the pressing member 101*r*, but the embodiment is not limited thereto. If the pressurizing is performed by a greater force, a rack and worm gear mechanism in which a worm gear is attached to the output shaft of the motor 101*m* may be employed instead of the rack gear.

Figure 6:
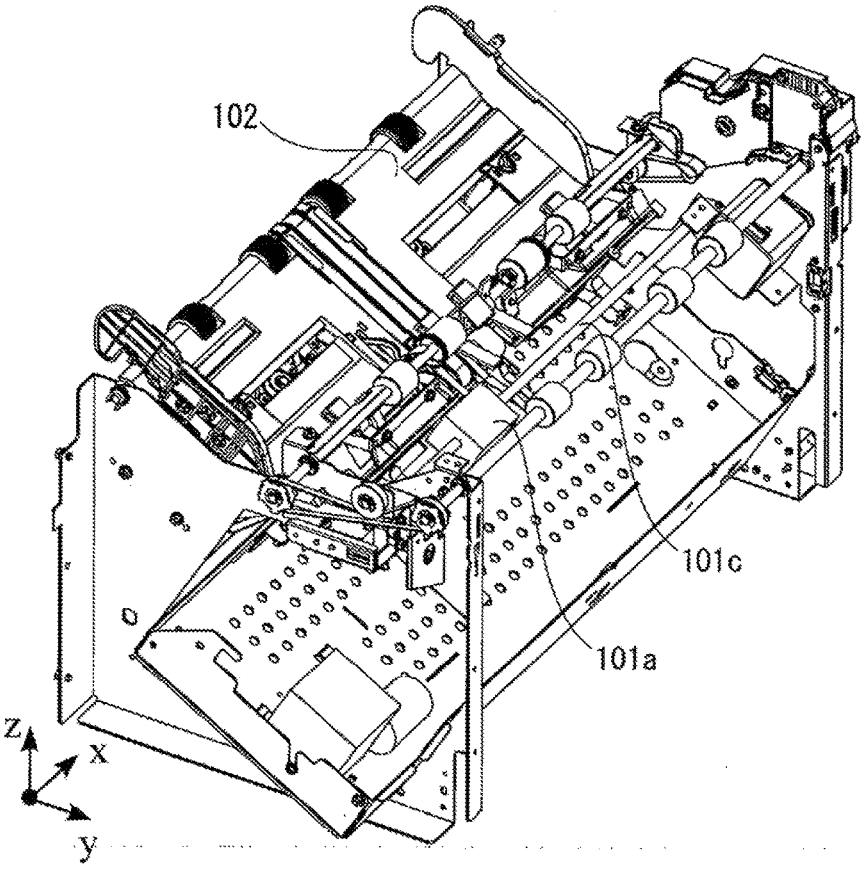
FIG. 6 is a perspective view of a processing tray and the binding section.

Thereafter, the bundle of sheets bound by the binding is discharged onto a second discharge tray 105 by a discharge member (not illustrated) provided in the processing tray 102, for example. FIG. 6 is a perspective view of the processing tray 102.

Figure 7:
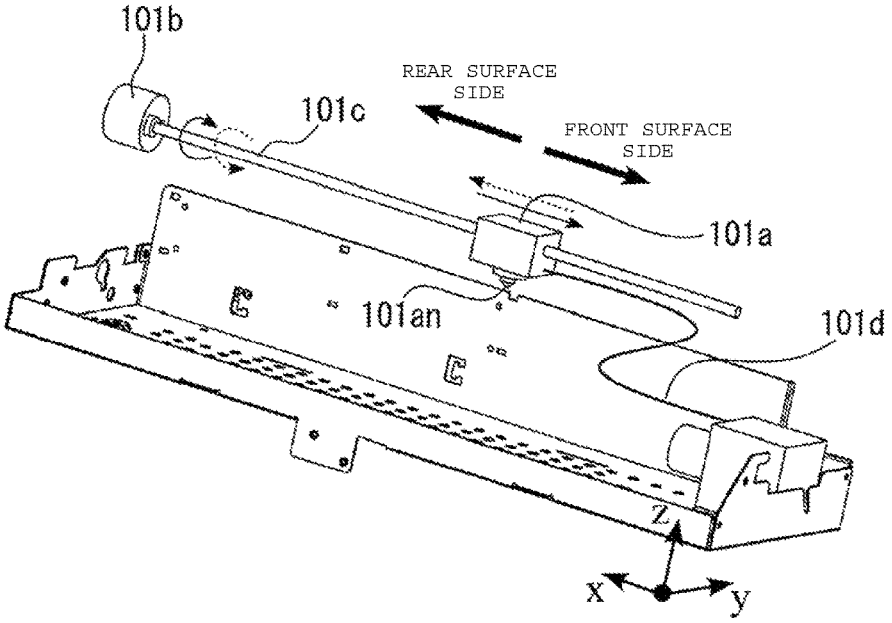
FIG. 7 is a perspective view of a pasting section of the binding section.

FIG. 7 is a perspective view of the pasting section 101 in the binding section T. As illustrated in FIG. 7, the pasting section 101 includes a pasting head 101*a* (a pasting unit), a supply tube 101*d*, a shaft 101*c*, a motor 101*b*, and the like. The shaft 101*c* having a worm gear formed on an outer circumferential surface thereof supports the pasting head 101*a* so that the pasting head 101*a* can make a reciprocating motion in the arrow direction indicated in FIG. 7. The shaft 101*c* is coupled to an output shaft of the motor 101*b* and rotates in accordance with the rotation of the motor 101*b*. Specifically, if the motor 101*b* rotates in a normal direction, the pasting head 101*a* moves in one direction due to an operation of the worm gear of the shaft 101*c*. If the motor 101*b* rotates in a reverse direction, the pasting head 101*a* moves toward the opposite direction due to an operation of the worm gear of the shaft 101*c*.

A liquid paste is supplied to the pasting head 101*a*, which is supported to be able to make the reciprocating motion, via the supply tube 101*d* by a pump (not illustrated). A liquid paste supplied to the pasting head 101*a* is sprayed from a nozzle 101 an provided in the pasting head 101*a* to a desired region on the top surface of a sheet stacked on the processing tray 102.

In the binding section T (the pasting section), it is possible to selectively perform pasting on at least any one of a plurality of "predetermined target regions for pasting," which are different from one another, on a target sheet for pasting. Positions of the plurality of "predetermined target regions for pasting" on the sheet are set in advance. As the pasting head 101*a*, it is possible to employ a configuration similar to that of an ink jet-type printer head which ejects a pressure-sensitive adhesive by driving a piezoelectric element or a thermal element.

Here, the binding section T is disposed inside the post-processing apparatus 1 as an example as shown in FIG. 1. However, the configuration is not necessarily limited thereto. For example, the binding section T may be provided at a different place inside the apparatus such as places where the hole punching section 109 and the folding section B are located.

Figure 8:
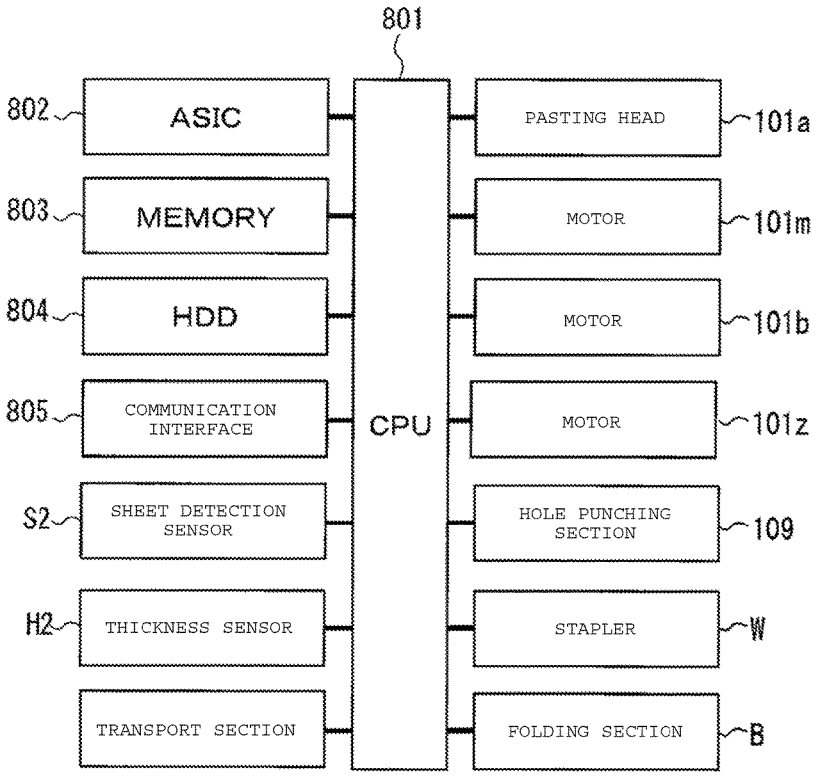
FIG. 8 illustrates control blocks of a post-processing apparatus including a sheet binding device according to an embodiment.

FIG. 8 is a block diagram of components of the post-processing apparatus 1 including a sheet binding device according to the embodiment.

As illustrated in FIG. 8, the post-processing apparatus 1 includes a CPU 801, an application specific integrated circuit (ASIC) 802, a memory 803, a hard disk drive (HDD) 804, the pasting head 101*a*, the motor 101*m*, the motor 101*z*, the motor 101*b*, the hole punching section 109, the stapler W, the folding section B, a communication interface 805, the sheet detection sensor S2, the thickness sensor H2, and the transport section (described above), for example.

Various actuators and sensors such as the ASIC 802, the memory 803, the HDD 804, motor 101*m*, the motor 101*b*, and the communication interface 805 included in the post-processing apparatus 1 are connected to the CPU 801 through a communication line such as a parallel bus or a serial bus so as to be able to communicate with each other.

The CPU 801 acquires detection results of the sheet detection sensor S2 and the thickness sensor H2. The CPU 801 also acquires a detection result of a media sensor (not illustrated) if the post-processing apparatus 1 includes the media sensor.

For example, the CPU 801 loads the memory 803 with a program which is downloaded from the HDD 804 or outside the apparatus and executes the program, thereby controlling the pasting head 101*a*, the motor 101*m*, the motor 101*z*, the motor 101*b*, the communication interface 805, and the transport section, for example.

In the sheet binding device according to the present embodiment and the post-processing apparatus 1 including the same, the CPU 801 has a role to perform various types of processing in the sheet binding device and the post-processing apparatus 1 including the same. The CPU 801 also has a role to achieve various functions by executing a program stored in the memory 803, the HDD 804, and the like. It is not necessary to mention that the CPU 801 may be replaced by a micro processing unit (MPU) which may execute equivalent arithmetic processing. Similarly, the HDD 804 may be replaced by a storage device such as a flash memory, for example.

For example, the memory 803 may include a random access memory (RAM), a read only memory (ROM), a dynamic random access memory (DRAM), a static random access memory (SRAM), a video RAM (VRAM), and a flash memory. The memory 803 has a role to store various pieces of information and programs utilized to operate the sheet binding device and the post-processing apparatus 1 including the same, for example.

According to such a configuration, the CPU 801 (a sheet quantity information acquisition section and a thickness information acquisition section) may also acquire sheet quantity information indicating quantity of sheets bound by adhesion and information indicating a thickness of a sheet from a CPU 701 of the image forming apparatus 7 through communication interfaces 705 and 805.

Figure 9:
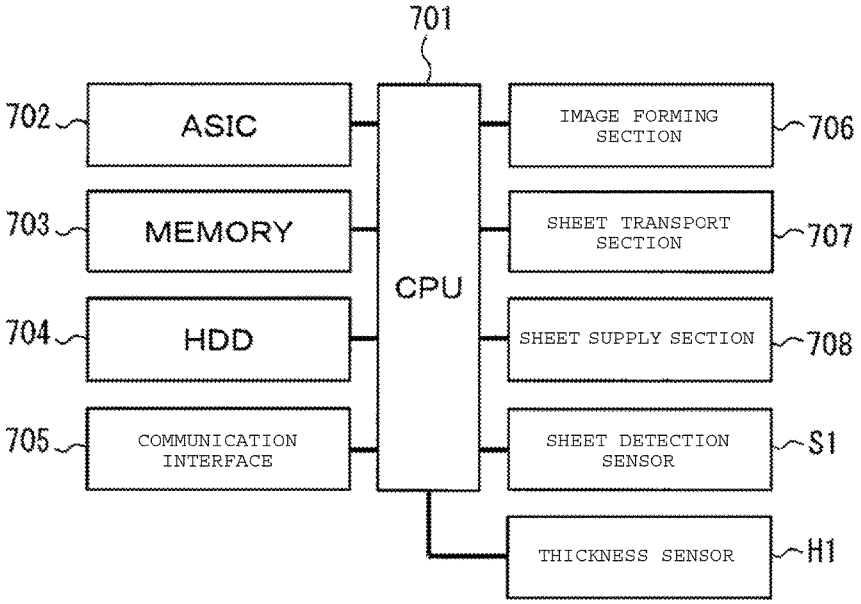
FIG. 9 is a block diagram of components of the image forming apparatus connectable to the post-processing apparatus according to the embodiment.

FIG. 9 is a block diagram of components of the image forming apparatus 7, which may be connected to the post-processing apparatus 1 of the embodiment.

As illustrated in FIG. 9, the image forming apparatus 7 includes the CPU 701, an application specific integrated circuit (ASIC) 702, a memory 703, a hard disk drive (HDD) 704, the communication interface 705, the image forming section 706, the sheet transport section 707, the sheet supply section 708, the sheet detection sensor S1, and the thickness sensor H1, for example.

Various actuators and sensors such as the ASIC 702, the memory 703, the HDD 704, and the communication interface 705 included in the image forming apparatus 7 are connected to the CPU 701 through a communication line such as the parallel bus or the serial bus so as to be able to communicate with each other.

The CPU 701 acquires information detection results of the sheet detection sensor S1 and the thickness sensor H1. The CPU 701 also acquires a detection result of a media sensor (not illustrated) if the image forming apparatus 7 includes the media sensor.

For example, the CPU 701 loads the memory 703 with a program which is downloaded from the HDD 704 or outside the apparatus and executes the program, thereby controlling the pasting head 101*a*, the motor 101*m*, the motor 101*z*, the motor 101*b*, and the communication interface 705, for example.

In the image forming apparatus 7 according to the present embodiment, the CPU 701 has a role to perform various types of processing in the image forming apparatus 7. The CPU 701 also has a role to achieve various functions by executing a program stored in the memory 703 and the HDD 704. It is not necessary to mention that the CPU 701 may be replaced by the micro processing unit (MPU) which may execute equivalent arithmetic processing. Similarly, the HDD 704 may be replaced by the storage device such as the flash memory, for example.

For example, the memory 703 may include the random access memory (RAM), the read only memory (ROM), the dynamic random access memory (DRAM), the static random access memory (SRAM), the video RAM (VRAM), and the flash memory. The memory 703 has a role to store various pieces of information and programs utilized in the image forming apparatus 7, for example.

According to such a configuration, the CPU 701 may transmit sheet quantity information indicating quantity of sheets bound by adhesion and information indicating a thickness (basis weight) of a target sheet for binding to the post-processing apparatus 1 through the communication interface 705.

Here, the CPU 801 basically carries out arithmetic processing in the post-processing apparatus 1, and the CPU 701 basically carries out arithmetic processing in the image forming apparatus 7. However, the embodiment is not limited thereto. For example, from a point of view of distributed processing, the CPU 801 may auxiliarily carry out arithmetic processing in the image forming apparatus 7, and the CPU 701 may auxiliarily carry out arithmetic processing in the post-processing apparatus 1. A program executed in the CPU of any one of the post-processing apparatus 1 and the image forming apparatus 7 may be stored in a storage region included in the other one or both of the post-processing apparatus 1 and the image forming apparatus 7.

Detailed Description for Sheet Binding Device

Subsequently, the sheet binding device of the embodiment will be described in detail.

Figure 10:
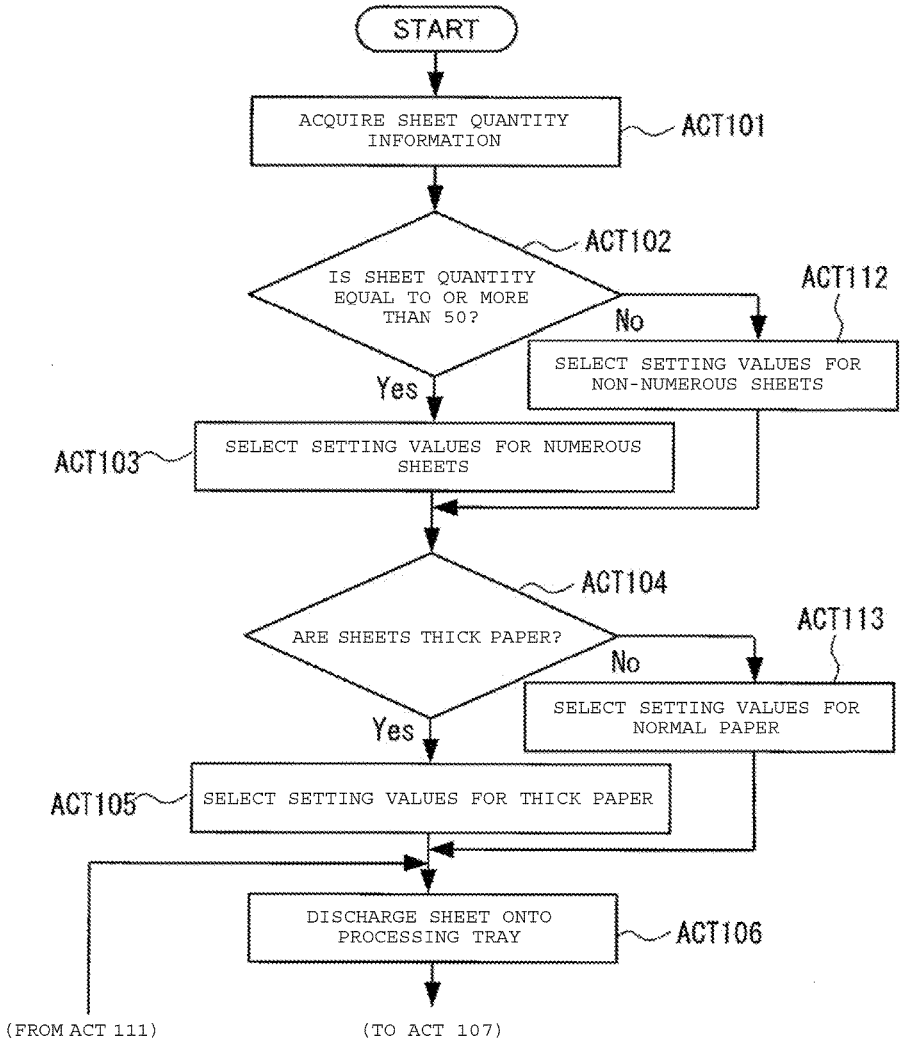
FIG. 10 is a flowchart illustrating a flow of an operation carried out by the sheet binding device according to the embodiment.
Figure 11:
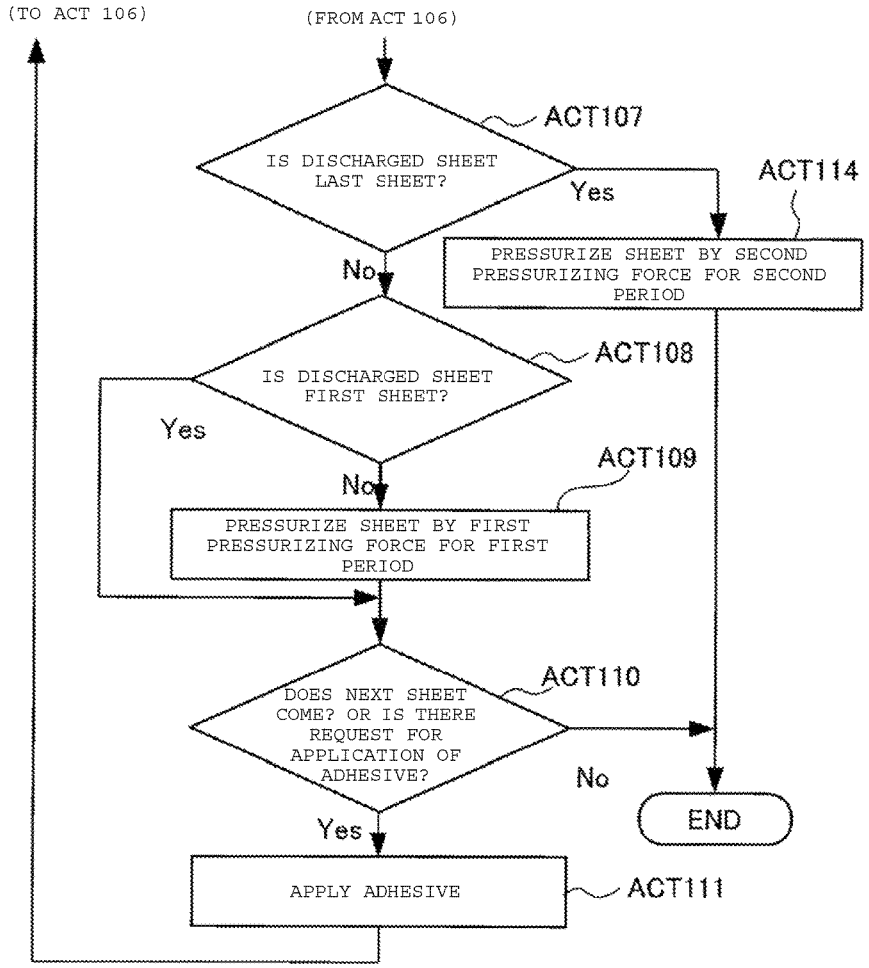
FIG. 11 is a flowchart illustrating a subsequent flow of the operation carried out by the sheet binding device according to the embodiment.

FIGS. 10 and 11 are flowcharts illustrating flows of processing carried out by the sheet binding device of the embodiment. The processing flows shown herein are examples. For example, execution order of multiple processes including determination and acquisition of setting values may be changed as long as the same processing outcome may be obtained as a result. Further, a part or all of the processing may be executed at the same time.

The CPU 801 (the sheet quantity information acquisition section) acquires sheet quantity information indicating quantity of sheets for binding in the post-processing apparatus 1 from the CPU 701 of the image forming apparatus 7 (ACT 101). The CPU 701 of the image forming apparatus 7 may acquire the sheet quantity information from "a print job" and the like when executing image forming (binding is designated for the post-processing) on a plurality of sheets, for example.

Figures 12, 13:
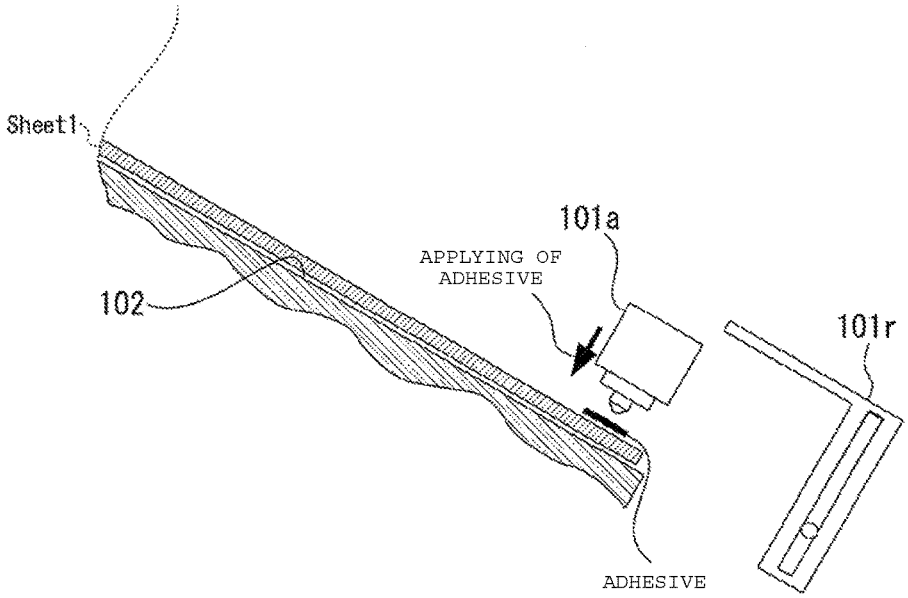
FIG. 12 illustrates a data table including defined pressurization setting parameters.
FIGS. 13-18 illustrate a state of the sheet binding device during the operation.

The CPU 801 acquires pressurization setting parameters corresponding to the acquired sheet quantity information from the data table in FIG. 12 stored in the HDD 804 (ACTS 102, 103, and 112). In the data table shown in FIG. 12, a pressurization force and a pressurization period corresponding to each of conditions such as quantity of sheets for binding (bundle forming sheet quantity) and types of the sheets (sheet type) for binding are regulated in advance.

Here, the pressurization force and the pressurization period are stored in the HDD 804 in advance in a form of a data table. However, the stored data may be in any form as long as the setting values such as the pressurization force and the pressurization period corresponding to a certain condition may be obtained as a result. For example, arithmetic expressions may be stored in the HDD 804 in advance and arguments such as quantity of sheets may be input to calculate the setting values such as desired pressurization force and pressurization period.

In ACTS 102, 103, and 112, the CPU 801 (a pressurization control section) is set to cause the pressurization period during which the pressurization mechanism D (the pressurization section) pressurizes sheets by a second pressurization force to be increased if the total quantity of the sheets for binding exceeds predetermined value (49 sheets in the example shown in FIG. 12) relative to when the total quantity thereof is equal to or less than the predetermined value, based on the setting values in the data table shown in FIG. 12 (selection of a multi-sheet setting value group). In the data table shown in FIG. 12, if the quantity of the sheets for binding is "equal to or less than 49," the pressurizing with respect to the sheet stacked on the processing tray 102 second from the top is set to be performed under conditions such as pressurization force F1=0.05 [N] and pressurization duration T1 (1.0 [Sec]) for "normal paper," and pressurization force F1=0.08 [N] and pressurization duration T1 (1.5 [Sec]) for "thick paper."

The pressurization duration may be proportional to strength of sheet adhesion by an adhesive to some extent. If the number of the sheets for binding exceeds the predetermined value (for example, 50 sheets or the like), the pressurization duration is set to be further increased compared to a case of pressurizing a bundle of sheets of which number is equal to or less than the predetermined value. Thus, by changing pressurization duration, it is possible to stably perform binding of a bundle of thick sheets.

Generally, as a bundle of sheets increases in thickness, a force applied to a binding place when pages are flipped by a reviewer (when browsing information printed in each sheet) tends to increase. Therefore, it is preferable to strongly bind sheets by adhesion as the bundle of sheets increases in thickness. From a point of view thereof, it is preferable that the pressurization duration is caused to be increased so as to firmly bind the sheets if the number of sheets for binding exceeds the predetermined value.

The CPU 801 (the pressurization control section) causes a bundle of stacked sheets which has a first quantity of sheets to be pressurized by a first pressurization force and causes a compounded bundle of sheets which has a second quantity of sheets in a state (for example, a state where all the sheets configuring the bundle of target sheets for binding are stacked) where sheets are additionally stacked on the bundle of sheets which has the first quantity of sheets to be pressurized by a second pressurization force greater than the first pressurization force, based on the sheet quantity information acquired from the image forming apparatus 7, and based on the setting values in the data table shown in FIG. 12. In the data table shown in FIG. 12, for example, if quantity of "normal paper" sheets for binding is "equal to or less than 49," pressurizing with respect to a sheet (in a state where the quantity of stacked sheets is the first quantity of sheets) stacked on the processing tray 102 second from the top out of the bundle of target sheets for binding is set to be performed under a condition of pressurization force F1=0.05 [N], and pressurizing with respect to a sheet (in a state where the quantity of stacked sheets is the second quantity of sheets) lastly stacked on the processing tray 102 out of the bundle of target sheets for binding is set to be performed under a condition of pressurization force Fn=0.10 [N].

In the example shown in FIG. 12, values are set to be the same from a pressurization force F1 for the sheet stacked on the processing tray 102 second from the top out of the bundle of target sheets for binding to a pressurization force Fn−1 for the second last sheet stacked on the processing tray 102 out of the bundle of target sheets for binding. Only the pressurization force Fn for the last sheet stacked on the processing tray 102 out of the bundle of target sheets for binding is set to have a high value.

That is, in the example shown in FIG. 12, the pressurization force is set to have the following relationship.

$$F1=F2=F3= \ldots =Fn-1<Fn$$

Naturally, the setting values for the pressurization force and the pressurization duration are not limited to the above-described example. For example, the setting values may be set as follows so as to cause the pressurization force and the pressurization duration to sequentially increase every time a sheet is stacked.

$$F1<F2<F3< \ldots <Fn-1<Fn$$

Otherwise, the setting may be performed as follows so as to apply the same setting values consecutively to several sheets during a sheet stacking procedure.

$$F1<F2=F3< \ldots =Fn-1<Fn$$

The setting may be performed as follows without being limited to the case where the pressurization force Fn for the last sheet stacked on the processing tray 102 out of the bundle of target sheets for binding is set to be the greatest.

$$F1<F2=F3< \ldots <Fn-1=Fn$$

In this manner, the pressurization force for the compounded bundle of additionally stacked sheets (for example, quantity of stacked sheets is 30 sheets) which has the second quantity of sheets greater than the first quantity of sheets is further strengthened compared to the pressurization force when pressurizing the bundle of stacked sheets (for example, quantity of stacked sheets is 15 sheets) which has the first quantity of sheets so that every single sheet in a stack is bound by adhesion to some extent by easily pressurizing the sheets by the relatively weak first pressurization force until the stacked sheets reach the second quantity of stacked sheets. Then, the compounded bundle of sheets which has the second quantity of stacked sheets is strongly pressurized by the second pressurization force greater than the first pressurization force if the stacked sheets reach the second quantity of stacked sheets, and thus, additional adhesion may be performed between the sheets configuring the compounded bundle of sheets which has the second quantity of stacked sheets with a uniform force.

Accordingly, since the binding may proceed by repeating easy pressurizing operations by a weak pressurization force until quantity of sheets stacked on the tray reaches the second quantity of stacked sheets, time necessary for the sheet pressurizing operations until quantity of stacked sheets reaches the second quantity of stacked sheets may be shortened, and thus, it is possible to decrease throughput of the binding process as a whole.

When quantity of sheets stacked on the tray reaches the second quantity of stacked sheets, the pressurizing is performed by the strong second pressurization force so that the pressurizing may be performed again between the compounded bundle of sheets with a uniform force. As a result, the binding may be more reliably performed.

Generally, as quantity of stacked sheets increases, a greater pressurization force is necessary to sufficiently perform pressure-bonding between a sheet positioned on the top (for example, a 30th sheet stacked thereon) and a sheet positioned immediately under the top sheet (for example, a 29th sheet stacked thereon). This is because a bundle of sheets stacked below the sheet to be pressed works as a cushion. According to the sheet binding device of the embodiment, there is no disadvantage caused by an insufficient pressurization force due to an increase of the quantity of stacked sheets, and it is possible to prevent an occurrence of poor adhesion when binding a bundle of sheets by adhesion.

If a bundle of target sheets for binding is collectively pressurized in its entirety after being stacked on the tray, it is necessary to perform pressurizing with an extremely great force compared to the present embodiment. However, a pressurization mechanism which can perform the pressurizing with such an extremely great force is likely to increase in size and causes a disadvantage from a point of view of space saving. In contrast, according to the sheet binding device of the present embodiment, it is possible to obtain sufficient adhesion force even though pressurizing is performed by a small force. Therefore, extensive miniaturization of the pressurization mechanism itself may be achieved while exhibiting a great effect from a point of view of energy saving as well as space saving, compared to a case of collectively pressurizing all sheets at a time to perform binding of a bundle of sheets in its entirety by adhesion. Meanwhile, if all the sheets are collectively subjected to pressurizing, there is not only an increase of the pressurization mechanism in size but also an increase of pressurizing time period. If the pressurization time period is short, there is no need to retard a transport operation for a next sheet to be stacked on the tray following after a target sheet for pressurizing. In contrast, if the pressurization time period is increased, the next sheet may have to standby until the pressurization operation for the immediately preceding sheet is completed when performing the transporting for the next sheet to be stacked on the tray following after the target sheet for pressurizing. Consequently, there is a need to control a throughput of sheet being transported toward the tray by slowing down the productivity of the sheet binding device to keep pace with the pressurizing period thereof. In other words, it takes significant amount of time if a bundle of sheets is collectively pressurized in its entirety at the last to bind the bundle of sheets by adhesion by only collectively pressurizing the bundle of sheets in its entirety at the last. Whereas the overall time for binding by adhesion may be generally shortened and productivity may be improved by setting the pressurization time period for each sheet to be stacked to an appropriate time period and increasing the time period when collectively pressurizing the bundle of sheets in its entirety at the last to be slightly longer than the time when performing binding by adhesion sheet by sheet.

The CPU 801 (the pressurization control section) sets a bundle of stacked sheets which has the first quantity of sheets to be pressurized for a first time period and sets a compounded bundle of sheets which has the second quantity of sheets to be pressurized for a second time period longer than the first time period, based on the sheet quantity information acquired from the image forming apparatus 7, and based on the setting values in the data table shown in FIG. 12. In the data table shown in FIG. 12, for example, if quantity of sheets configuring a bundle of target sheets of "normal paper" for binding is "equal to or less than 49," the pressurizing with respect to a sheet (in a state where the quantity of stacked sheets is the first quantity of sheets) stacked on the processing tray 102 second from the top out of the bundle of target sheets for binding is set to be performed under a condition of pressurization duration T1 (1.0 [Sec]), and pressurizing with respect to a sheet (in a state where the quantity of stacked sheets is the second quantity of sheets) lastly stacked on the processing tray 102 out of the bundle of target sheets for binding is set to be performed under a condition of pressurization duration T2 (5.0 [Sec]).

In the example shown in FIG. 12, values are set to be the same from a pressurization duration T1 for the sheet stacked on the processing tray 102 second from the top out of the bundle of target sheets for binding to a pressurization duration Tn−1 for the second last sheet stacked on the processing tray 102 out of the bundle of target sheets for binding. Only a pressurization duration Tn for the last sheet stacked on the processing tray 102 out of the bundle of target sheets for binding is set to be long.

That is, in the example shown in FIG. 12, the pressurization duration is set to have the following relationship.

$$T1=T2=T3= \ldots =Tn-1<Tn$$

Naturally, the setting value for the pressurization duration is not limited to the above-described example. For example, the setting value may be set as follows so as to cause the pressurization duration to increase every time a sheet is stacked.

$$T1<T2<T3< \ldots <Tn-1<Tn$$

Otherwise, the setting may be performed as follows so as to apply the same setting value consecutively to several sheets during a sheet stacking procedure.

$$T1<T2=T3< \ldots =Tn-1<Tn$$

The setting may be performed as follows without being limited to the case where the pressurization duration Tn for the last sheet stacked on the processing tray 102 out of the bundle of target sheets for binding is set to be the greatest.

$$T1<T2=T3< \ldots <Tn-1=Tn$$

Considering the pressurization duration may be proportional to strength of sheet adhesion generated by an adhesive to some extent when sheets interposing the adhesive therebetween are pressurized to adhere to each other, when a compounded bundle of target sheets for binding has the second quantity of sheets, the pressurization duration is caused to be further increased compared to a case of pressurizing a bundle of sheets which has the first quantity of sheets. As a result, it is possible to stably perform binding of a bundle of thick sheets.

Generally, as quantity of stacked sheets increases, a greater pressurization force is necessary to sufficiently perform pressure-bonding between a sheet positioned on the top and a sheet positioned immediately under the top sheet. This is because a bundle of sheets stacked below the sheet to be pressed works as a cushion.

Considering that the pressurization duration may be proportional to strength of sheet adhesion generated by an adhesive when sheets interposing the adhesive therebetween are pressurized to adhere to each other, when a compounded bundle of target sheets for binding has the second quantity of sheets, the pressurization duration is caused to be increased compared to a case of pressurizing a bundle of sheets which has the first quantity of sheets. As a result, it is possible to stably perform binding of a bundle of thick sheets. According to the sheet binding device of the embodiment, an insufficient pressurization force due to an increase of the quantity of stacked sheets is compensated by extending a pressurization time period, thereby preventing an occurrence of poor adhesion when binding a bundle of sheets.

The CPU 801 (the thickness information acquisition section) acquires thickness information regarding thicknesses of target sheets for binding from detection results of the thickness sensors H1 and H2 or the CPU 701 of the image forming apparatus 7 (ACT 104).

If a portion or all of sheets for binding have the second thickness (for example, a thickness of thick paper) thicker than the first thickness (for example, a thickness of normal paper), the CPU 801 (the pressurization control section) sets an increasing rate of the second pressurization force to the first pressurization force to be greater than that in a case of binding a bundle of sheets which have only the first thicknesses, based on thickness information acquired by the CPU 801 (the thickness information acquisition section), with reference to the setting values in the data table shown in FIG. 12 (ACT 105).

Generally, it is known that a greater pressurization force is necessary as a bundle of sheets includes thicker sheets when performing binding by adhesion. Therefore, in the present embodiment, as shown in the data table in FIG. 12, if a portion (for example, if only covers or inserts are thick paper) or all of a bundle of target sheets for binding are thick sheets such as thick paper, pressure-bonding is performed by a pressurization force stronger than the pressurization force applied when "the bundle of sheets include only sheets thinner than the thick sheets."

If a portion or all of sheets for binding have the second thickness (for example, a thickness of thick paper) thicker than the first thickness (for example, a thickness of normal paper) (ACT 104, Yes), the CPU 801 (the pressurization control section) sets an increasing rate of the second period to the first period to be greater than that in a case of binding a bundle of sheets includes sheets which have only the first thicknesses based on thickness information acquired by the CPU 801 (the thickness information acquisition section) with reference to the setting values in the data table shown in FIG. 12 (ACT 105) (refer to the data table in FIG. 12).

Generally, it is known that a greater pressurization force is necessary as a bundle of sheets includes thicker sheets when performing the binding by adhesion. Therefore, in the present embodiment, if a portion (for example, if only covers or inserts are thick paper) or all of a bundle of target sheets for binding are thick sheets such as thick paper, pressure-bonding is performed for a duration longer than the pressurization duration applied when "the bundle of sheets includes only sheets thinner than the thick sheets."

Subsequent to parameter setting of pressurizing operations performed in the above-described manner (ACTS 101 to 105), the CPU 801 causes the target sheet for binding transported from the image forming apparatus 7 to be introduced onto the processing tray 102 by the flapper and the transport roller (ACT 106). The parameter setting of pressurizing operations (ACTS 101 to 105) may be performed every time each sheet to be bound is stacked on the processing tray 102. However, set parameters for pressurizing operations respectively corresponding to sheets may be collectively set before starting transporting of sheets individually.

As described above, if target sheets for pressurizing is the last sheet to be stacked on the processing tray 102 out of a bundle of target sheets for binding (ACT 107, Yes), the CPU 801 (the pressurization control section) causes the pressurization mechanism D to perform pressurizing under conditions of pressurization force Fn (the second pressurization force) and pressurization duration Tn (the second period) based on set parameters acquired from the data table shown in FIG. 12 (ACT 114).

Meanwhile, if target sheets for pressurizing is not the first or last sheet to be stacked on the processing tray 102 out of a bundle of target sheets for binding (ACT 107, No) (ACT 108, No), the CPU 801 (the pressurization control section) causes the pressurization mechanism D to perform pressurizing under conditions of pressurization force F1 to pressurization force Fn−1 (the first pressurization force) and pressurization duration T1 to pressurization duration Tn−1 (the first period) based on set parameters acquired from the data table shown in FIG. 12 (ACT 109).

Next, when an adhesive is ready to be applied to "the top sheet" on sheets stacked on the processing tray 102, if "a next sheet" being transported toward the processing tray 102 so as to be stacked on the processing tray 102 next to "the top sheet," which is a target to be applied with the adhesive, is not detected by the sheet detection sensor S1 or S2 (ACT 110, No), the CPU 801 (a control unit) causes the pasting section 101 (the adhesive applying section) not to perform an adhesive applying operation onto the "top sheet."

In other words, only when "the next sheet" being transported toward the processing tray 102 so as to be stacked on the processing tray 102 next to "the top sheet," which is a target to be applied with the adhesive, is detected by the sheet detection sensor S1 or S2 (ACT 110, Yes), the CPU 801 (the control unit) allows the pasting section 101 (the adhesive applying section) to perform an adhesive applying operation onto the "top sheet" (ACT 111).

Here, for example, "when an adhesive is ready to be applied to the top sheet" denotes a state where an adhesive is ready to be applied to a sheet when the sheet stacked on the tray is not a front cover or a rear cover for a bundle of target sheets for binding but is "a sheet to be applied with an adhesive as per usual." In other words, "when an adhesive is ready to be applied to the top sheet" includes a standby state for applying an adhesive to the sheet and a state where an operation to apply an adhesive to the sheet is started.

In ACT 110, when determining whether or not "the next sheet" is transported toward the processing tray 102, the CPU 801 (a supply information acquisition section) may acquire a signal (supply information) indicating whether or not a sheet is supplied from the image forming apparatus 7 (an external device), for example. It may be determined that "the next sheet" is transported onto the processing tray 102 if the CPU 801 (the supply information acquisition section) receives the signal.

In ACT 110, the CPU 701 (a determination unit) of the image forming apparatus 7 may determine whether or not sheet is transported to the post-processing apparatus 1 (including the sheet binding device) by the transport section 707 and the like. The CPU 701 (an applying request section) may request (command transmission) the post-processing apparatus 1 to apply an adhesive to an immediately preceding sheet that is transported toward the processing tray 102 prior to "the next sheet" only if it is determined that "the next sheet" is transported to the post-processing apparatus 1.

"Immediately preceding" denotes the immediately preceding transport order in a plurality of sheets which are sequentially transported. For example, when three target sheets for binding are transported in an order of a first sheet, a second sheet, and a third sheet, the immediately preceding sheet of the second sheet (the next sheet) is the first sheet, and the immediately preceding sheet of the third sheet (the next sheet) is the second sheet.

FIG. 13 illustrates a state where the pasting head 101*a* applies an adhesive onto the top surface of a sheet (Sheet 1) which is first stacked on the processing tray 102 as a sheet for binding. As illustrated in FIG. 13, if a next sheet (Sheet 2) is discharged to be stacked on Sheet 1 which is applied with an adhesive, the CPU 801 (the pressurization control section) causes the pressing member 101*r* of the pressurization mechanism to be lowered and presses the top surface of Sheet 2 down by the pressurization force F1 for the pressurization duration T1, thereby performing pressure-bonding for Sheet 1 and Sheet 2 using the adhesive (FIG. 14).

Figure 14:
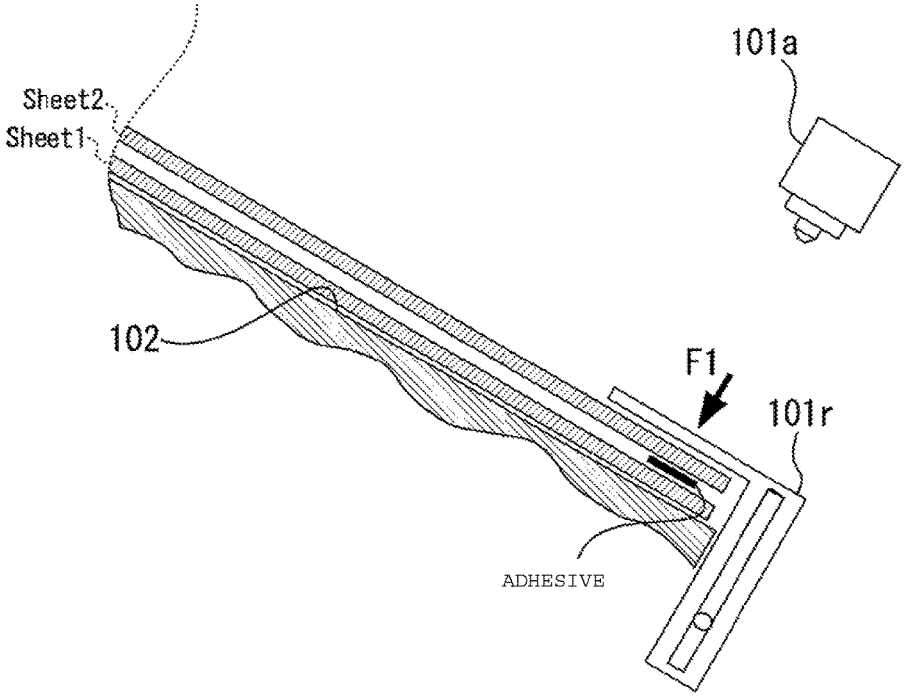
Figure 15:
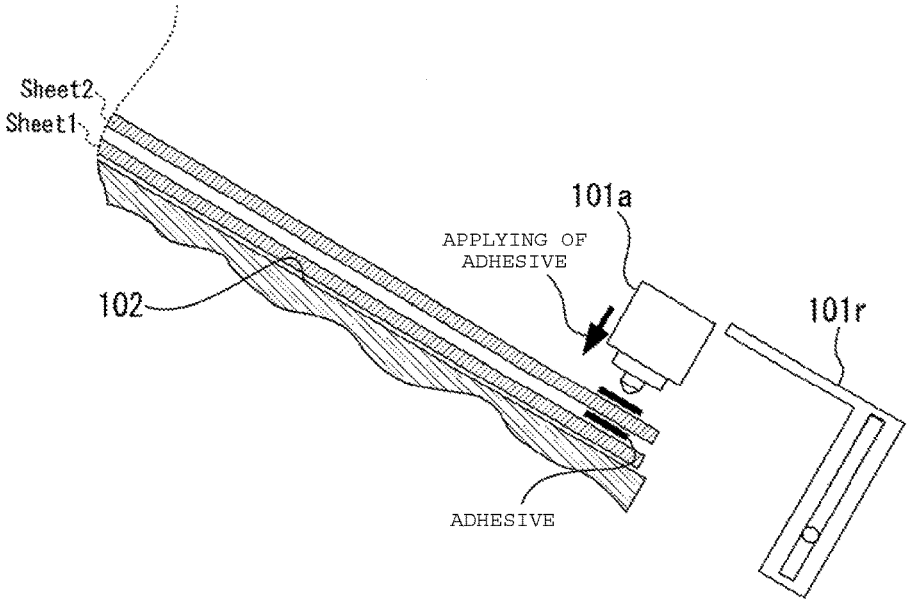
Figure 16:
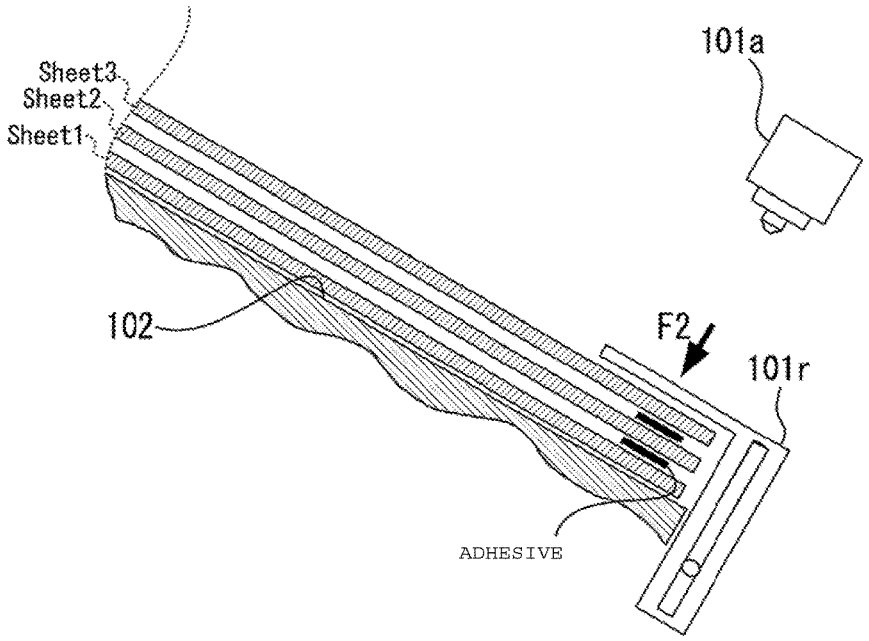
Figure 17:
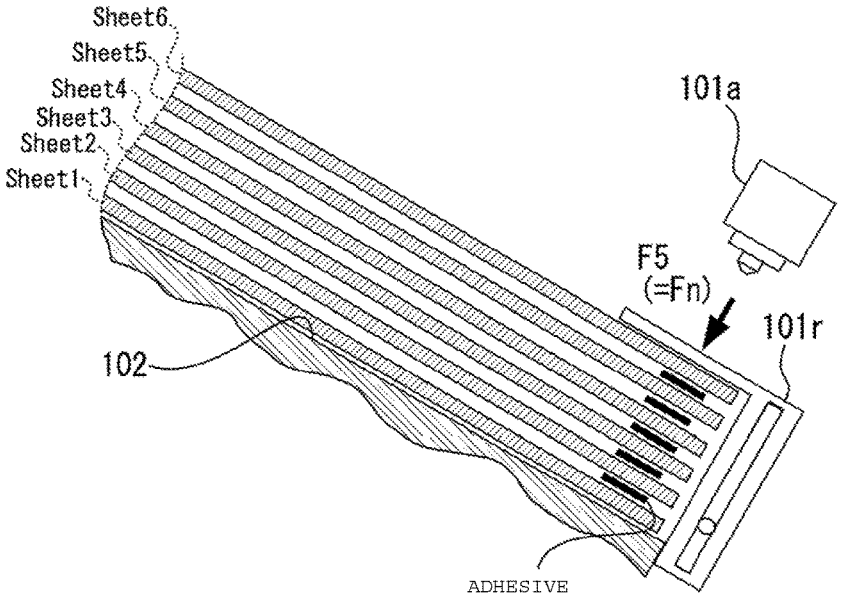

As illustrated in FIG. 14, similar to Sheet 1, the pasting head 101*a* applies the adhesive onto the top surface of Sheet 2 which is pressed down (FIG. 15). If a next sheet (sheet 3) is discharged to be stacked on Sheet 2 which is applied with an adhesive, the CPU 801 (the pressurization control section) causes the pressing member 101*r* of the pressurization mechanism to be lowered and presses the top surface of Sheet 3 down by a pressurization force F2 for a pressurization duration T2, thereby performing pressure-attaching for Sheet 1 to Sheet 3 (FIG. 16).

In this manner, a series of processing from the application of the adhesive to the pressurization is carried out every time a sheet is stacked on the processing tray 102. Here, for example, if a bundle of target sheets for binding includes six sheets in total (Sheet 1 to Sheet 6), the CPU 801 (the pressurization control section) does not perform applying of an adhesive onto the sheet (Sheet 6) which is lastly stacked on the processing tray 102 out of the six sheets. The CPU 801 performs only pressurizing of the sheet (Sheet 6) by the pressurization force Fn for the pressurization duration Tn (FIG. 16).

Figure 18:
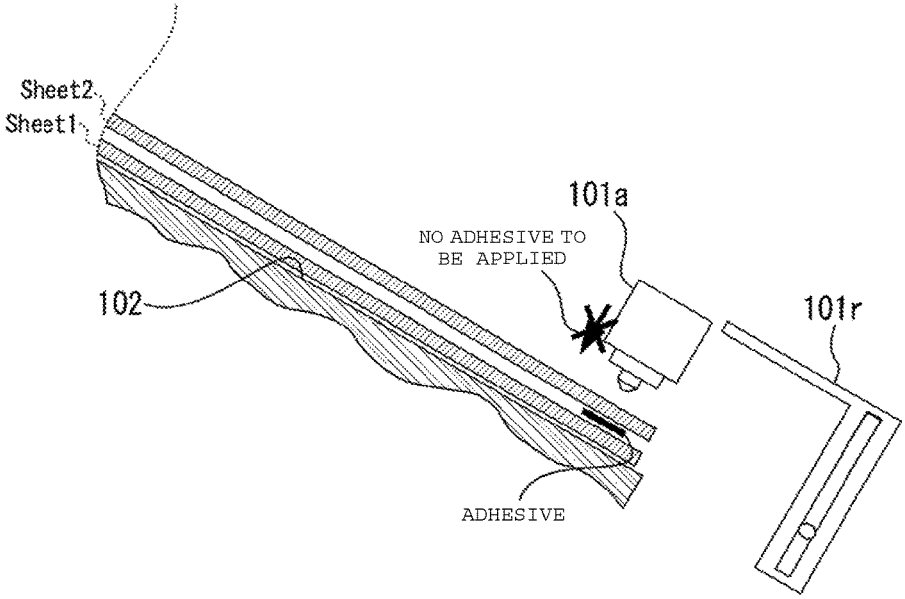

However, as shown in the above-described ACT 110, even if the adhesive applying operation is ready to be performed with respect to a sheet waiting for applying of the adhesive, unless the CPU 801 acquires information indicating that a next sheet is stacked on the processing tray 102, the adhesive applying operation is not carried out (FIG. 18).

By performing the adhesive applying operation according to such processing algorithm, for example, even though the sheet binding in the post-processing apparatus 1 is interrupted due to machine trouble such as sheet jamming or absence of sheet in the sheet feeding cassette occurred on the image forming apparatus 7 side or the post-processing apparatus 1 side during the execution of the sheet binding, the adhesive will not be applied onto the top surface of a bundle of sheets (for example, Sheet 1 and Sheet 2 shown in FIG. 18) in which binding is performed half way. Accordingly, the adhesive applied onto the outer surface of the bundle of sheets is not exposed even in the bundle of sheets for which the sheet binding is performed half way, and thus, it is possible to improve convenience when the binding of a bundle of sheets is interrupted. Naturally, even if the sheet binding is interrupted in this manner (if there is no next target sheet for binding), the CPU 801 causes the pressing member 101*r* of the pressurization mechanism to be lowered, thereby pressing down the top surface of the sheet on the top in which the application of the adhesive is interrupted, with an appropriate pressurization force for the sheet. Accordingly, even if the sheet binding is interrupted due to some reasons such as sheet jamming, a sheet group stacked in a state of retaining the adhesive is subjected to pressure-bonding in the meantime. Thus, when the reasons of interruption no longer exist, it is possible to restart the binding for subsequent sheets (for example, from the fourth sheet of a bundle of sheets out of five sheets in total) with the sheets (for example, up to third sheet of a bundle of sheets out of five sheets in total) for which the pressure-bonding has been performed.

In the above-described example, both of setting values of the pressurization force and the pressurization duration are changed so that a pressurizing effect is further increased when the second quantity of sheets stacked on the processing tray 102 are bound relative to when the first quantity of sheets is bound. However, the setting values are not limited thereto. For example, only one setting value of the pressurization force and the pressurization duration may be set to be changed so that the pressurizing effect is further increased.

Each operation of processing in the above-described post-processing apparatus is achieved by causing the CPU 801 to execute a sheet binding program stored in the memory 803, for example.

MODIFICATION EXAMPLE

In the above-described embodiment, a pasting unit which performs pasting on a sheet is not necessarily limited to a unit which sprays the liquid paste. For example, some other methods may be adopted as follows.

Figure 19:
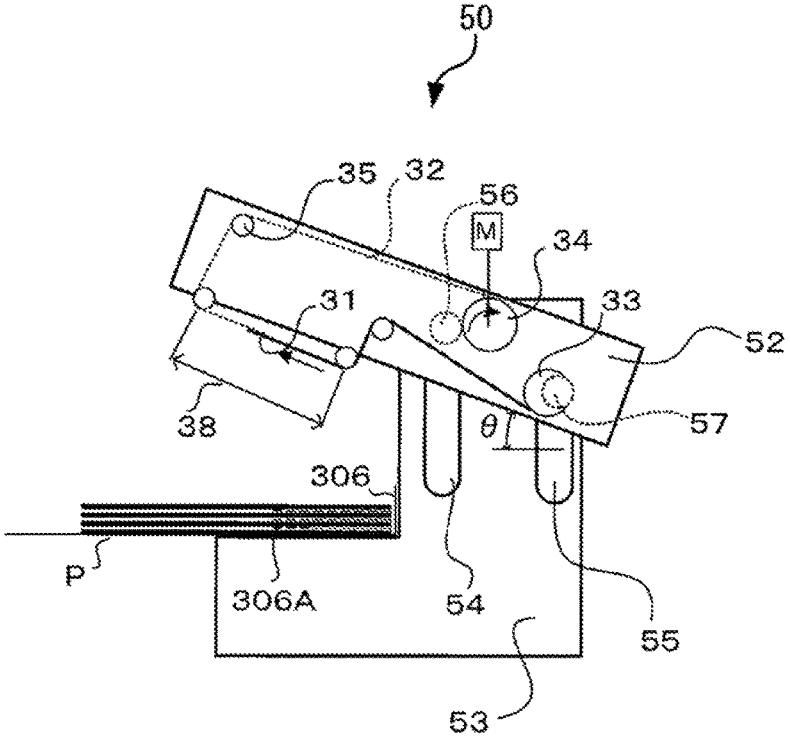
FIG. 19 is a vertical cross-sectional view of a tape stamping apparatus as an example of the post-processing apparatus.
Figure 20:
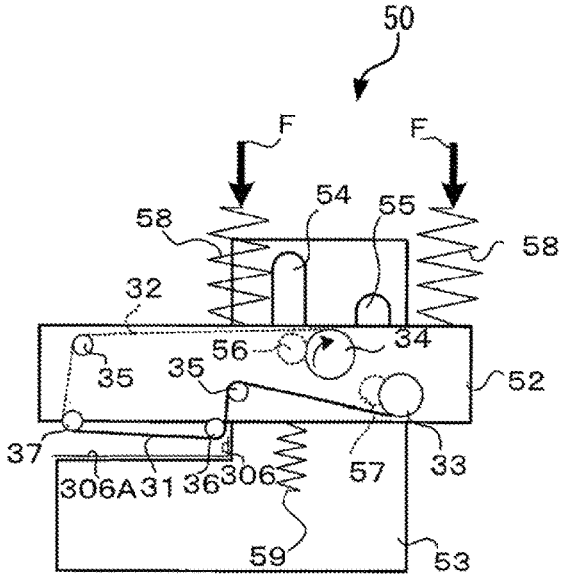
FIG. 20 is a vertical cross-sectional view of another tape stamping apparatus as an example of the post-processing apparatus.

(1) Pasting with a two-sided tape of which both sides are applied with an adhesive (2) Coating with an pasty adhesive (3) Coating with a liquid adhesive (4) Coating with a stick adhesive For example, if (1) is employed, a tape stamping apparatus 50 as shown in FIGS. 19 and 20 may be included as the adhesive applying section.

The tape stamping apparatus 50 is disposed to be close to a positioning section 306 against which trailing edges of sheets of paper P in a vertical alignment direction abut so as to align leading edges of the sheets of paper P.

The tape stamping apparatus 50 has a tape head 52 and a stamp stand 53 which tiltably holds the tape head 52. As illustrated in FIG. 19, the tape head 52 is tiltable between a standby position at an angle θ (0 degrees<θ<90 degrees) upward with respect to a paper placement surface 306A of the positioning section 306, and a pressing position parallel to the paper placement surface 306A. At the standby position, the tape head 52 is lifted upper than the maximum level of the paper placement surface 306A to which the paper P may be stacked, and is tilted to easily receive the paper P in the positioning section 306 when the paper P is dropped to be supplied to the processing tray 102. Naturally, the tape head 52 may not be tilted at the standby position.

A series of operation during which the tape head 52 is tilted from the standby position to the pressing position, applies a pressurizing force F so as to bond the paper P and a cut adhesive sheet portion (described later), and then, returns to the standby position is referred to as a tape head stamping operation.

A mechanism to carry out the tape head stamping operation has a first long hole 54 which is formed in the stamp stand 53 and is elongated in a vertical direction, a second long hole 55 of which an upper end is lower than that of the first long hole 54, a first engagement pin 56 which engages with the first long hole 54, and a second engagement pin 57 which engages with the second long hole 55. In the mechanism, the first engagement pin 56 and the second engagement pin 57 are attached to side surface of the tape head 52. The first engagement pin 56 engages with an auxiliary long hole (not illustrated) which is elongated in a longitudinal direction with respect to the side surface of the tape head 52. Accordingly, after the second engagement pin 57 reaches the upper end of the second long hole 55, the first engagement pin 56 may move to the upper end of the first long hole 54. As the first engagement pin 56 moves in the auxiliary long hole, the tape head 52 starts to tilt having the second engagement pin 57 as a fulcrum.

The pressurizing force F generated in a pressurizing force applying section (not illustrated) is downwardly applied to the tape head 52 through a first elastic body 58 such as a spring. If the pressurizing force F is applied to the tape head 52, the tape head 52 moves downward against an elastic force of a second elastic body 59 such as a spring. If the first engagement pin 56 reaches the upper end position of the second long hole 55, the tape head 52 is in a horizontal posture as in FIG. 20. The tape head 52 is lowered while maintaining the horizontal posture and a transfer abutment surface (described below) of a tape abuts on the surface of the paper P. Even though the pressurizing force F is applied to the first elastic body 58 in the aforementioned state, the tape head 52 is not further lowered, and the first elastic body 58 is caused to contract, thereby pasting the two-sided adhesive sheet to the paper P.

If application of the pressurizing force F is terminated, an elastic force accumulated in the second elastic body 59 is released, thereby returning the tape head 52 back to the standby position. In this case, a pasted portion of the two-sided adhesive sheet which is pasted on the paper P remains as a cut adhesive sheet section.

A roll tape 33 in which a tape-like two-sided adhesive sheet 31 is peelably pasted on one side of a strip-like mounting tape 32 indicated by a dotted line so as to be wound in a rolled shape is disposed in the tape head 52. The beginning end side of the roll tape 33 is wound around a winding shaft 34. The roll tape 33 is wound around two folding-back rollers 35, and transfer abutment surface forming rollers 36 and 37 which separately face each other along a vertical alignment direction. The winding shaft 34 is rotated by a tape winding mechanism that has a motor M and the like, thereby performing winding of the roll tape. The first transfer abutment surface forming roller 36 and the second transfer abutment surface forming roller 37 protrude downward from a lower surface of the tape head 52, thereby causing a space between the rollers in the vertical alignment direction to be a transfer abutment surface 38. In a lower surface 52A of the tape head 52, a portion corresponding to the transfer abutment surface 38 is formed on a wall surface, and the mounting tape 32 abuts thereon.

In a direction along the space between the first transfer abutment surface forming roller 36 and the second transfer abutment surface forming roller 37 (hereinafter, referred to as a width direction), a drawn-out amount of the roll tape 33 is controlled by controlling rotations of the motor M, and thus, a width of the two-sided adhesive sheet 31 drawn out from the first transfer abutment surface forming roller 36 in the width direction may be adjusted. If the width of the two-sided adhesive sheet 31 is short, adhesion between the sheets of paper P is weak. For example, if the paper P is thick paper, due to a firm property of the sheet, a great peeling force is likely to be added in a direction of peeling adhesion when turning pages of the bundle of sheets. In this case, when the width of the two-sided adhesive sheet 31 is wide, an adhesion force becomes strong in response thereto. If the paper P thin, a peeling force added to the adhesion portion is weak.

Therefore, adhesion strength may be adjusted by adjusting the width of the two-sided adhesive sheet 31 drawn out to the transfer abutment surface 38.

For example, the pressurization mechanism D shown in FIG. 2 is a mechanism independent from the pasting section 101 performing coating with the adhesive. However, if the mechanism shown in FIG. 19 is employed, "application of an adhesive" may be carried out when a sheet is pressed down in a state where the two-sided adhesive sheet 31 is drawn out, and thus, if the sheet is pressed down in a state where a portion in which the two-sided adhesive sheet 31 is peeled off in the mounting tape 32 is exposed, only pressing-down of the sheet may be performed without applying the adhesive.

In the above-described embodiment, although the "coating" of the paste is used, the expression denotes not only simply "applying" the paste on a sheet but also includes ejecting such as a spray as well as pasting a tape-type adhesive as shown in FIG. 19 and stamp-type pasting, for example. That is, any methods can be used as long as the paste is applied on the surface of a sheet as a result of the processing. Without being limited to a case where an adhesive in a single body adheres to a sheet, it is possible to employ a two-sided adhesive sheet in which both sides of the sheet-like base material are covered with an adhesive.

In the above-described embodiment, a pressure sensitive paste is used as the adhesive. However, the embodiment is not limited thereto. For example, the adhesive adopted in the present embodiment may be an adhesive of which adhesion is decreased or is substantially dissipated by receiving high-temperature heat or low-temperature heat so as to be applicable for reuse. Adhesion of the adhesive used in the adhesion portion may be decreased or be substantially dissipated by receiving light.

The "sheet" in the above-described embodiment is not necessarily limited to paper. For example, it is acceptable as long as the sheet is a sheet-like medium which may be bound by applying paste such as an OHP film sheet.

In the above-described embodiment, a request for applying of an adhesive is transmitted from the CPU 701 of the image forming apparatus 7 to the post-processing apparatus 1. However, the embodiment is not limited thereto. For example, it is possible to cause an automatic text transport device which performs only transporting of sheets to the post-processing apparatus 1 to transmit the request for applying of the adhesive to the post-processing apparatus 1.

As a sheet binding program, a program for executing each of the above-described operations in a computer configuring a sheet binding device and a post-processing apparatus including the same may be provided. In the present embodiment, the program for realizing functions to execute the exemplary embodiment is recorded in a storage region provided inside the apparatus in advance. However, the embodiment is not limited thereto. The similar program may be downloaded from the network to the apparatus, and a computer-readable recording medium in which the similar program is stored may be installed in the apparatus. As the recording medium, any type of recording medium may be used as long as the recording medium may store a program and may be read by a computer. Specifically, as the recording medium, for example, an internal storage device such as a ROM and a RAM which are mounted inside a computer; a portable storage medium such as a CD-ROM, a flexible disk, a DVD disk, a magneto-optical disk, and an IC card; database holding a computer program; other computers and database thereof; and a transmission medium on a line may be exemplified. A function obtained by installation or download in advance as described above may realize its function in association with an OS (operating system) inside the apparatus.

A portion or whole program may be a dynamically generated execution module.

At least a portion of various types of processing carried out in the above-described embodiment by executing a program in a CPU or MPU may be executed using a circuit of the ASIC 802.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet processing apparatus comprising:

a sheet holder;

a sheet conveyor configured to convey a plurality of sheets to be bound, which are three or more, one by one onto the sheet holder;

an adhesive dispenser;

a sheet presser; and a controller configured to:

determine a total number of the sheets that are to be bound, control the adhesive dispenser to apply an adhesive material on a surface portion of each of the sheets that is held on the sheet holder before another one of the sheets that immediately follows is conveyed onto the sheet, except for last one of the sheets, and control the sheet presser to press each of the sheets except for first one of the sheets, against the surface portion of an immediately-preceding sheet with a pressing force determined based on the total number and for a pressing time period determined based on the total number, after the sheet is conveyed onto the immediately-preceding sheet, the pressing time period during which the last one of the sheets is pressed by the sheet presser being longer than the pressing time period during which any non-last one of the sheets is pressed by the sheet presser.

2. The sheet processing apparatus according to claim 1, wherein the controller is further configured to determine a thickness of at least one of the plurality of sheets, and control the pressing force based on the determined thickness.

3. The sheet processing apparatus according to claim 1, wherein the controller is further configured to determine a thickness of at least one of the plurality of sheets, and control the pressing time period during which the sheet presser presses said each of the sheets except for the first one of the sheets, based on the determined thickness.

4. The sheet processing apparatus according to claim 1, wherein the adhesive dispenser is configured to move in a width direction of the sheets on the sheet holder.

5. The sheet processing apparatus according to claim 1, wherein the sheet presser presses an end surface of each of the sheets except for the first one of the sheets.

6. The sheet processing apparatus according to claim 1, wherein the controller determines the total number of the sheets to be bound based on sheet quantity information received from an image forming apparatus that is coupled with the sheet processing apparatus and supplies the plurality of sheets to be bound.

7. The sheet processing apparatus according to claim 1, wherein the total number of sheets is more than four, and the pressing time period during which any non-last one of the sheets is pressed by the sheet presser is uniform.

8. The sheet processing apparatus according to claim 7, wherein the pressing force with which the last one of the sheets is pressed by the sheet presser is greater than the pressing force with which any non-last one of the sheets is pressed by the sheet presser.

9. The sheet processing apparatus according to claim 8, wherein the pressing force with which any non-last one of the sheets is pressed by the sheet presser is uniform.

10. The sheet processing apparatus according to claim 8, wherein the pressing force with which any non-last one of the sheets is pressed by the sheet presser increases as the number of sheets conveyed onto the sheet holder increases.

11. A method for processing sheets, comprising:

conveying, along a conveyance path, a plurality of sheets to be bound, which are three or more, one by one onto a sheet holder;

determining a total number of the sheets to be bound;

applying an adhesive material on a surface portion of each of the sheets that is held on the sheet holder before another one of the sheets that immediately follows is conveyed onto the sheet, except for last one of the sheets; and pressing each of the sheets except for first one of the sheets against the surface portion of the an immediately-preceding sheet with a pressing force determined based on the total number and for a pressing time period determined based on the total number, after the sheet is conveyed onto the immediately-preceding sheet, the pressing time period during which the last one of the sheets is pressed being longer than the pressing time period during which any non-last one of the sheets is pressed.

12. The method according to claim 11, further comprising:

determining a thickness of at least one of the plurality of sheets, wherein the pressing force is determined also based on the determined thickness.

13. The method according to claim 11, further comprising:

determining a thickness of at least one of the plurality of sheets; and controlling the pressing time period during which said each of the sheets except for the first one of the sheets is pressed, based on the determined thickness.

14. The method according to claim 11, wherein the total number of the sheets to be bound is determined based on sheet quantity information received from an image forming apparatus that supplies the plurality of sheets to be bound.

15. The method according to claim 11, wherein the total number of sheets is more than four, and the pressing time period during which any non-last one of the sheets is pressed is uniform.

16. The method according to claim 15, wherein the pressing force with which the last one of the sheets is pressed is greater than the pressing force with which any non-last one of the sheets is pressed.

17. The method according to claim 16, wherein the pressing force with which any non-last one of the sheets is pressed by the sheet presser is uniform.

18. The method according to claim 16, wherein the pressing force with which any non-last one of the sheets is pressed increases as the number of sheets conveyed onto the sheet holder increases.

* * * * *